US008469752B2

(12) United States Patent
Park

(10) Patent No.: US 8,469,752 B2
(45) Date of Patent: Jun. 25, 2013

(54) ELECTRICAL CONNECTOR HAVING SHORTING BAR OPERATION DEVICE

(75) Inventor: Joo Hyun Park, Osan-si (KR)

(73) Assignee: Delphi International Operations Luxembourg, S.AR.L, Luxembourg (LU)

( * ) Notice: Subject to any disclaimer, the term of this patent is extended or adjusted under 35 U.S.C. 154(b) by 0 days.

(21) Appl. No.: 13/386,068

(22) PCT Filed: Jul. 20, 2010

(86) PCT No.: PCT/IB2010/002183

§ 371 (c)(1),
(2), (4) Date: Feb. 13, 2012

(87) PCT Pub. No.: WO2011/010224

PCT Pub. Date: Jan. 27, 2011

(65) Prior Publication Data

US 2012/0135620 A1 May 31, 2012

(30) Foreign Application Priority Data

Jul. 20, 2009 (WO) ..... PCT/IB2009/006705

(51) Int. Cl.
*H01R 13/4362* (2006.01)

(52) U.S. Cl.
USPC ..... 439/752

(58) Field of Classification Search
USPC ..... 439/752, 595, 744, 871
See application file for complete search history.

(56) References Cited

U.S. PATENT DOCUMENTS

| | | | | |
|---|---|---|---|---|
| 5,203,722 | A * | 4/1993 | Kinoshita | 439/595 |
| RE34,539 | E * | 2/1994 | Aoyama | 439/75 |
| 5,618,201 | A | 4/1997 | Yagi et al. | 439/489 |
| 5,647,754 | A | 7/1997 | Kohno | 439/188 |
| 6,913,494 | B2 * | 7/2005 | Ward et al. | 439/752 |
| 7,112,104 | B2 * | 9/2006 | Sagawa et al. | 439/752 |
| 7,114,997 | B2 * | 10/2006 | Sagawa et al. | 439/752 |
| 7,137,853 | B2 * | 11/2006 | Okamoto et al. | 439/752 |
| 8,075,351 | B2 * | 12/2011 | Park et al. | 439/752 |

FOREIGN PATENT DOCUMENTS

| | | |
|---|---|---|
| EP | 0 721 233 A2 | 7/1996 |
| EP | 1 276 175 A1 | 1/2003 |
| FR | 2 778 502 | 11/1999 |
| JP | 2009-146673 | 7/2009 |

* cited by examiner

*Primary Examiner* — Tulsidas C Patel
*Assistant Examiner* — Phuongchi T Nguyen
(74) *Attorney, Agent, or Firm* — Thomas N. Twomey

(57) ABSTRACT

The present invention relates to an electrical connector having a shorting bar and an operation device for controlling the shorting bar. The connector has a housing and electrical conductive terminals disposed in the housing. One or more metal shorting bars are attached to the housing, each shorting bar electrically connects two or more terminals as a protective measure to the systems connected to these terminals before the connector is connected to a counterpart connector. The operation device is movably disposed inside the housing. During the connecting process, the operation device is pushed by the counterpart connector to move relative to the housing towards the shorting bar. Upon completion of the connecting process, a portion of the operation device is inserted between the shorting bars and the terminals whereby the shorting bar are electrically isolated from the terminals to resume the original functions of these terminals.

9 Claims, 8 Drawing Sheets

A-A

ELECTRICAL CONNECTOR HAVING SHORTING BAR OPERATION DEVICE

FIELD OF THE INVENTION

The present invention relates to an electrical connector, and more particularly to an electrical connector having a shorting bar operation device.

BACKGROUND OF THE INVENTION

Electrical connectors provide electrical connections between devices in an electrical system, though contact terminals of the counterpart connectors. In some applications, for example in motorized vehicles which has a relatively higher level of safety requirements, some or all the contact terminals are temporarily short-circuited as a protective measure to devices connected to these terminals, before the electrical connection is established by mating the counterpart connectors. When the counterpart connectors are connected or mated, the temporary short circuit is broken, so as to assume normal connection functions of these terminals. When the connectors are disconnected, these terminals are short-circuited again and ready for a next time connection.

A shorting bar in the form of a metal piece is one typical type of device to provide the short-circuit function. A shorting bar is attached to the housing of a connector, with resilient contact portions urging against and electrically connect two or more contact terminals. The short circuit is not disconnected until the connector mates with a counterpart connector. Upon completion of mating, the short circuit is broken, so as to resume the electrical connection functions of these terminals.

In conventional connectors with the short circuit function, the shorting bar is attached to one of the connectors. On the counterpart connector, there is formed a thin plastic piece protruding outwardly from the connector housing. When the two connectors are brought together for mating, the protrusion is inserted between the shorting bar and the terminals to disconnect the shorting bar and the terminals. However, as the thin plastic piece faces the external side of the counterpart connector and is directly accessible from outside of the connector, such thin plastic piece is easy to be damaged during shipment or assembling process. Once the thin plastic piece is broken, the shorting bar on the counterpart connector can not be disconnected, which causes the whole connection system failure.

It is therefore desirable to provide an electrical connector with a safe and reliable shorting bar control device which can overcome the problems of conventional connectors.

SUMMARY OF THE INVENTION

The present invention provides an electrical connector having a shorting bar and an operation device for controlling the shorting bar. The connector has a housing and electrical conductive terminals disposed in the housing. One or more shorting bars are attached to the housing, each shorting bar electrically connects two or more terminals as a protective measure to the systems connected to these terminals before the connector is mated to a counterpart connector. The operation device is movably disposed inside the housing. During the mating process, the operation device is pushed by the counterpart connector to move relative to the housing towards the shorting bar. Upon completion of the mating process, an actuator of the operation device is inserted between the shorting bars and the terminals whereby the shorting bar are disconnected from the terminals to resume the original functions of these terminals. Because the operation device is located inside the housing and the actuator faces away from the mating interface, the operation device is prevented from being damaged during the manufacturing, shipping and/or the assembling processes. Shorting bars can be disconnected from the relevant terminals upon completion of the mating process, in a safer and more reliable manner. Electrical connection functions of the connectors are ensured.

For a better understanding of the present invention and its purpose and preferred embodiments, further description accompanied by figures is provided in detail below.

DETAILED DESCRIPTION OF PREFERRED EMBODIMENTS

Figure 1:
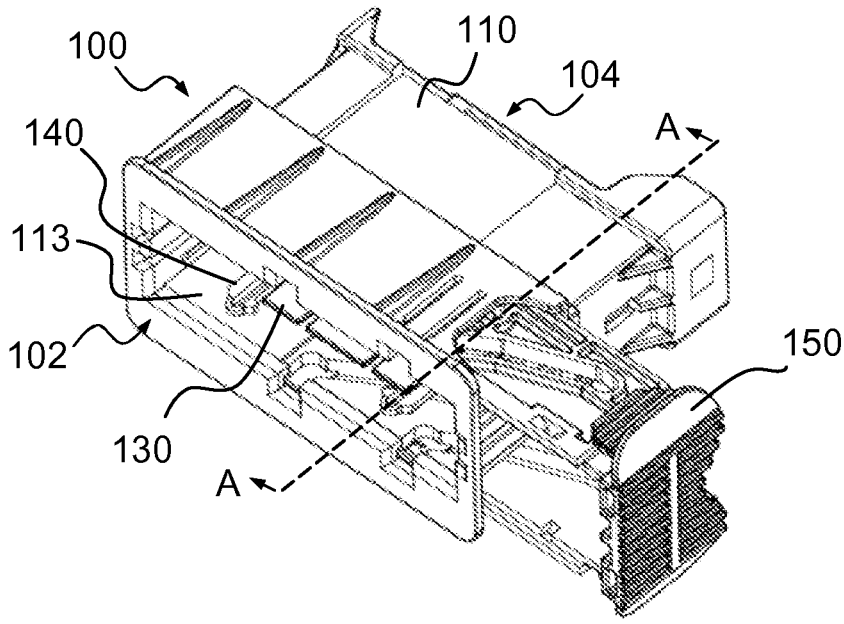
FIG. 1 is a perspective view of an electrical connector according to one embodiment of the present invention.
Figure 2:
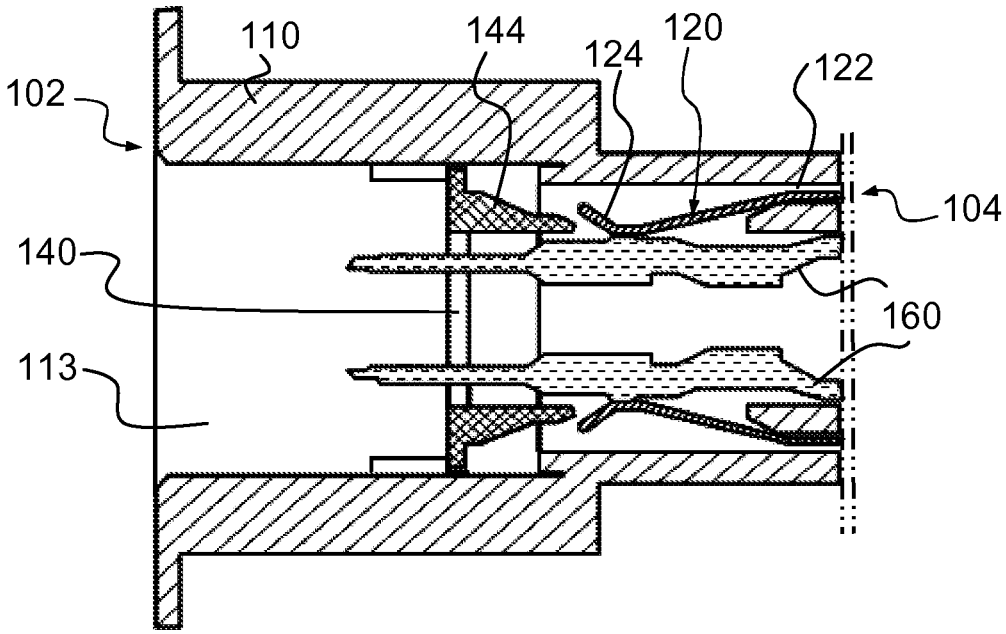
FIG. 2 is a partial cross sectional view of FIG. 1 along A-A.
Figure 3:
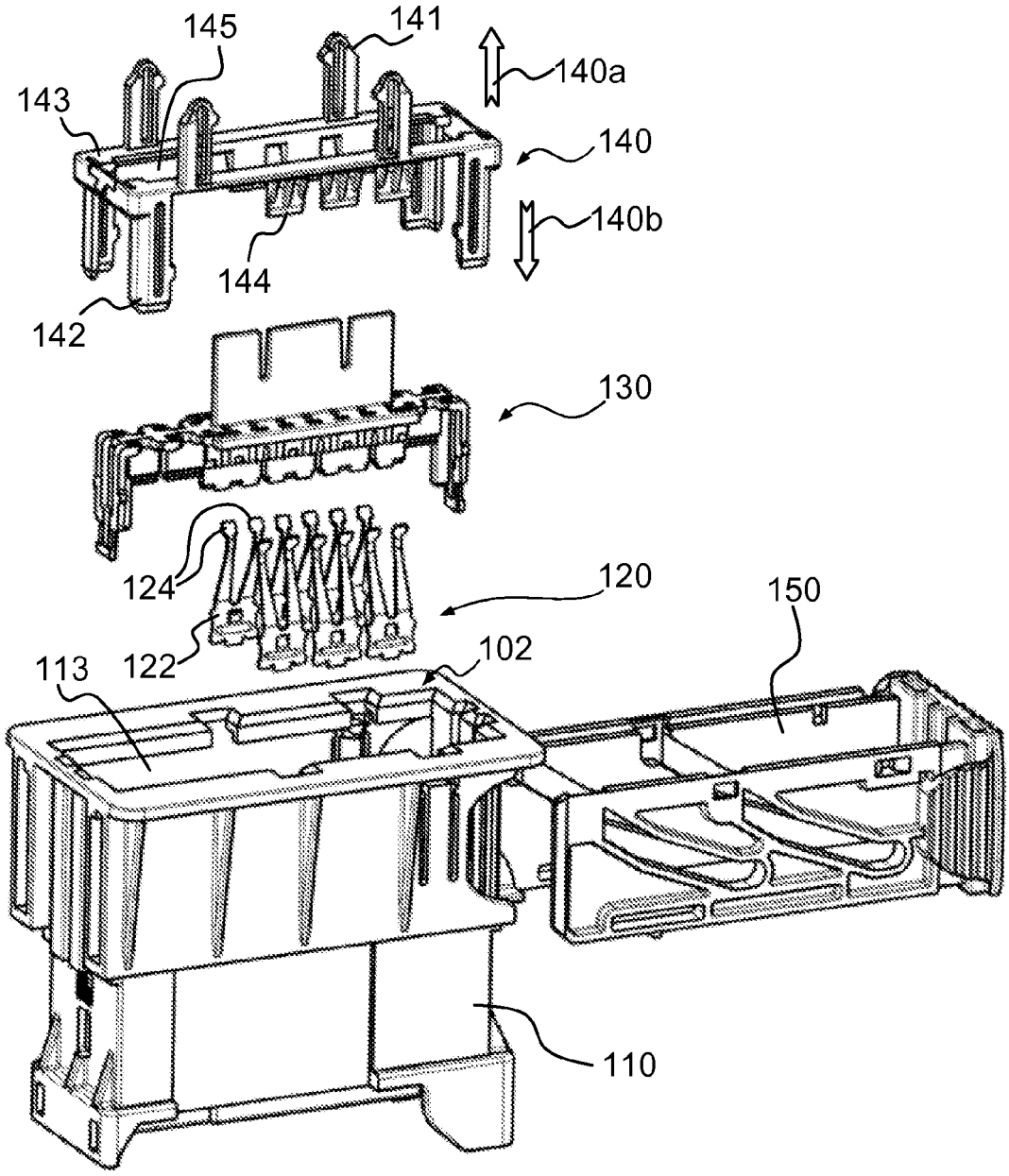
FIG. 3 is an exploded view of FIG. 1.

As shown in FIGS. 1, 2 and 3, an electrical connector 100 according to an embodiment of the present invention includes a housing 110 which has a cavity 113 opening at its front end 102, and contact terminals 160 disposed in housing 110. A Terminal Position Assurance (TPA) device 130 is disposed in housing 110 to support terminals 160 in correct positions. Connector 100 has one or more shorting bars 120 to temporarily short-circuit selected terminals. Each shorting bar 120 has a fixing portion 122 attached to housing 110, and two cantilevered resilient arms 124 each urging against one terminal 160, to electrically connecting the two terminals 160. Connector 100 may also have a slider 150 serving to lock a counterpart connector (not shown).

Figure 4:
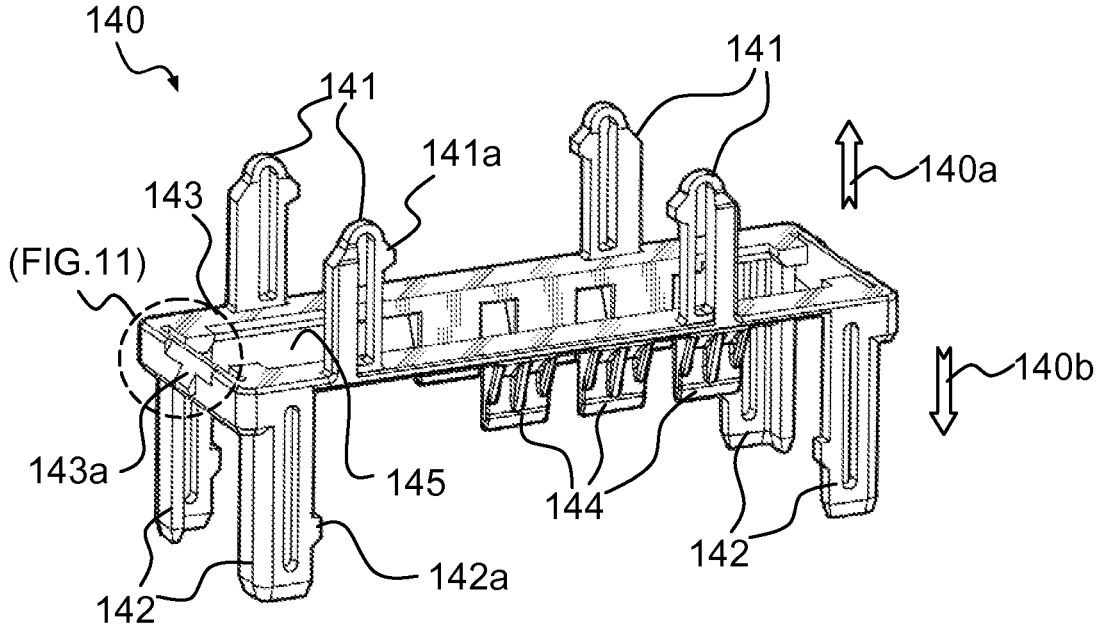
FIG. 4 is a perspective view of an operation device of the connector shown in FIG. 1.

An operation device 140 is movably disposed in cavity 113 of housing 110. As shown with further details in FIG. 4, operation device 140 has a base 143 of a frame shape corresponding to the dimension and shape of cavity 113, such that operation device is capable of moving relative to housing 110 inside cavity 113. Base 143 defines an opening 145 within which the terminals 160 and TPA device 130 are disposed. A set of first beams 141 is integrally formed on base 143, each projects along a first direction 140*a*. A set of second beams 142 is integrally formed on base 143, each projects along a second direction 140*b* opposite to first direction 140*a*. Each of the first beams 141 has a first locking projection 141*a* formed thereon along lateral direction. Each of the second beams 142 has a second locking projection 142*a* formed thereon along lateral direction. At opposite ends of base 143, shown as left and right ends in FIG. 4, there are formed a pair of third locking projections 143*a* (only the left locking projection is shown in FIG. 4). One or more actuators 144 are integrally formed on base 143, projecting along second direction 140*b*. When assembled into housing 110, operation device 140 is oriented with actuators 144 facing rear end 104 of housing 110 (FIG. 2).

Figure 5:
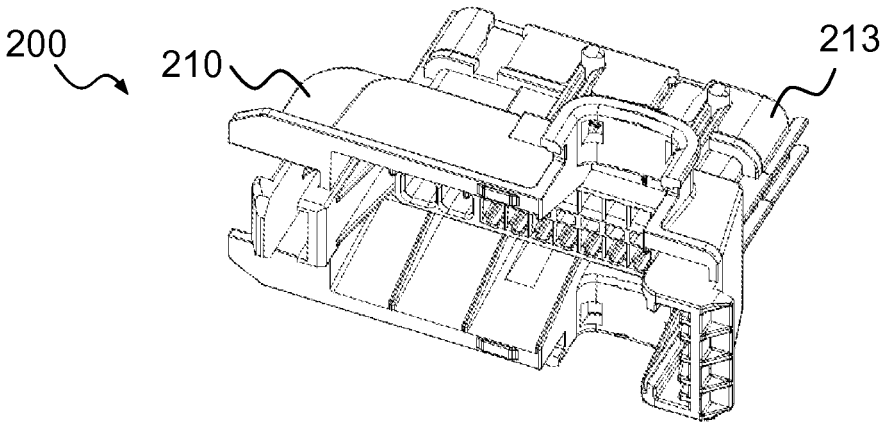
FIG. 5 is a perspective view of a counterpart connector to be mated with the connector of FIG. 1.

FIG. 5 shows a counterpart connector 200 which is to mate with connector 100 shown in FIG. 1. Counterpart connector 200 has a housing 210 and a protruding portion 213 form at one side of housing 210. Protruding portion 213 is to be inserted into cavity 113 of connector 100 upon which the two connectors 100 and 200 can be mated.

Figure 6:
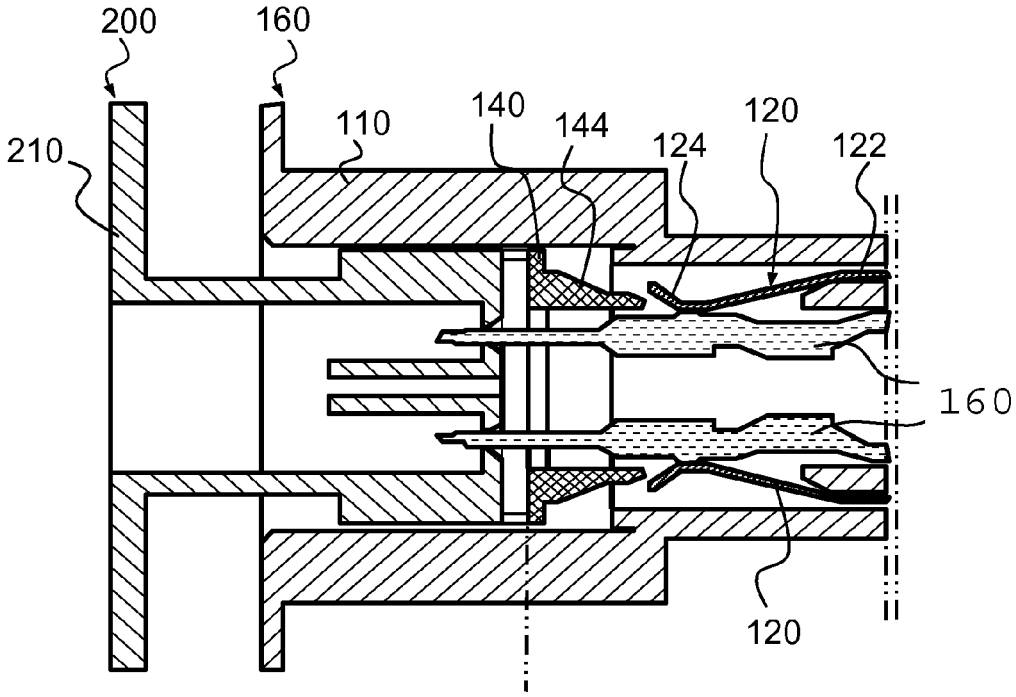
FIG. 6 is a cross sectional view showing the connectors shown in FIGS. 1 and 5 are brought together at a pre-mate position.

When connectors 100 and 200 are at the pre-mate position, as shown in FIG. 6, resilient arm 124 of shorting bar 120 urge against terminals 160 to provide the short circuit function. Meanwhile, operation device 140 is at a first position at which, actuator 144 is not in contact with shorting bar 120.

Figure 7:
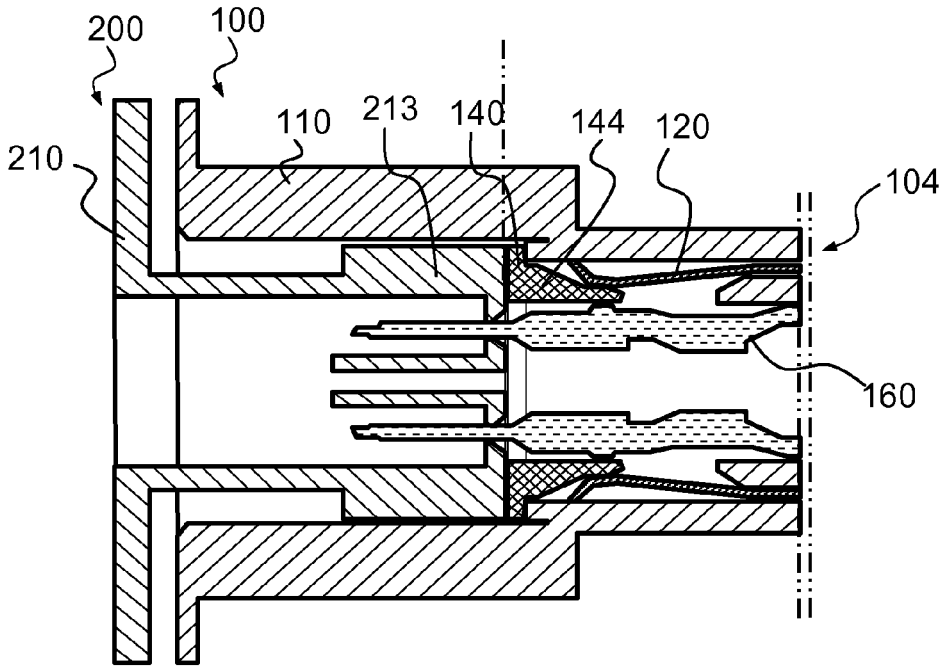
FIG. 7 is a cross sectional view showing the connectors shown in FIGS. 1 and 5 are at a final mate position.

When connectors 100 and 200 are at the final mate position, as shown in FIG. 7, operation device 140 is pushed to move towards rear end 104 of housing 110 to a second position. Movement of operation device 140 to the second position has the effect of inserting actuator 144 between arm 124 of shorting bar 120 and terminals 160, by deforming arm 124 away from terminal 160. Accordingly, when connectors 100 and 200 are at the final mate position, operation device 140 disconnects shorting bar 120 from at least one of the contact terminals 160, hence the short circuit established between terminals 160 by shorting bar 120 is broken. Original connection functions of these terminals are resumed.

Figure 8:
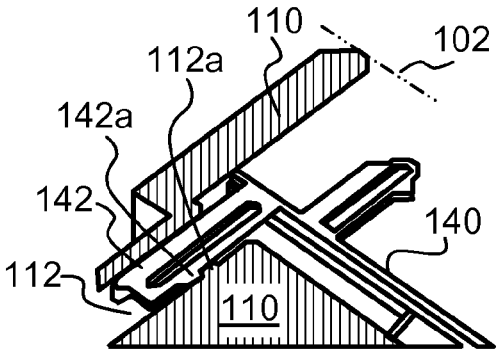
FIG. 8 is a partial cross sectional view of FIG. 1 showing a locking structure to prevent the locking device from dropping off the housing.

Positioning and locking features may also be provided to increase the reliability of the operation of the connectors according to the present invention. In one embodiment, as shown in FIG. 8, operation device 140 is assembled to housing 100 with each second beam 142 inserted into a corresponding groove 112 formed in housing 110. During the insertion process, second locking projection 142*a* acts against corresponding locking lug 112*a* formed in groove 112 whereby second beam 142 is resiliently deformed to allow second locking projection 142*a* to pass over corresponding locking lug 112*a*. After second locking projection 142*a* passes over corresponding locking lug 112*a*, second beam 142 returns to its original shape. By the engagement of locking projection 142*a* and locking lug 112*a*, operation device 140 is retained in housing 110. Operation device 140 is therefore prevented from moving towards first end 102 of housing 110, i.e. operation device 140 is prevented from being separated from housing 110.

Figure 9:
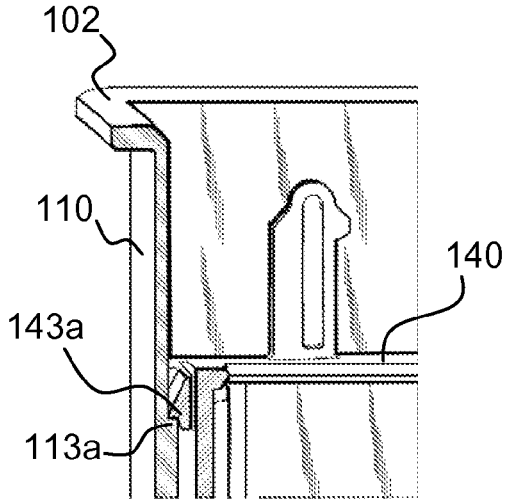
FIG. 9 is a partial cross sectional view of FIG. 1 showing a locking structure at the locked state, to prevent the operation device from moving to the final position before the two connectors are mated.

On the other hand, before connectors 100 and 200 are mated, e.g. during the shipment of connector 100 from the connector manufacturer to the connector assembler or connector system integrator, operation device 140 may also be prevented from accidentally disconnecting shorting bar 120. This movement prevention feature is provided by third locking projection 143*a* engaging a shoulder 113*a* formed inside cavity 113 of housing 110, as shown in FIG. 9.

Figure 10:
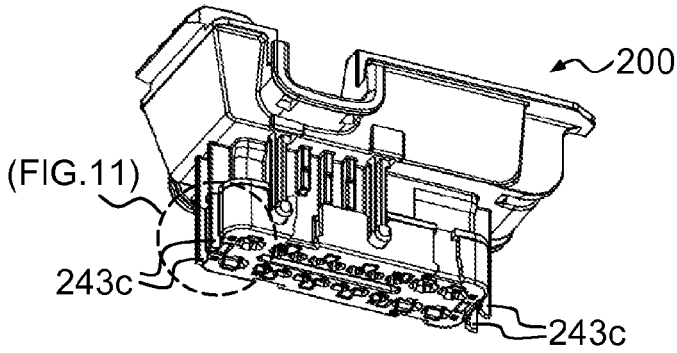
FIG. 10 is a perspective view of the counterpart connector from another viewing angle.
Figure 11:
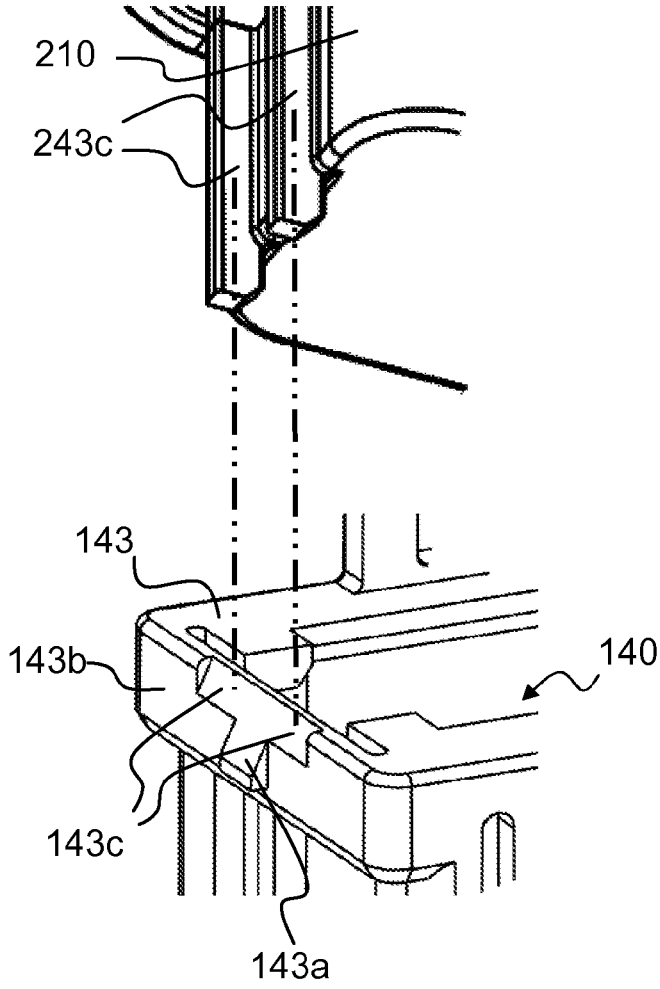
FIG. 11 is an enlarged partial perspective view of FIG. 4 and FIG. 10.
Figure 12:
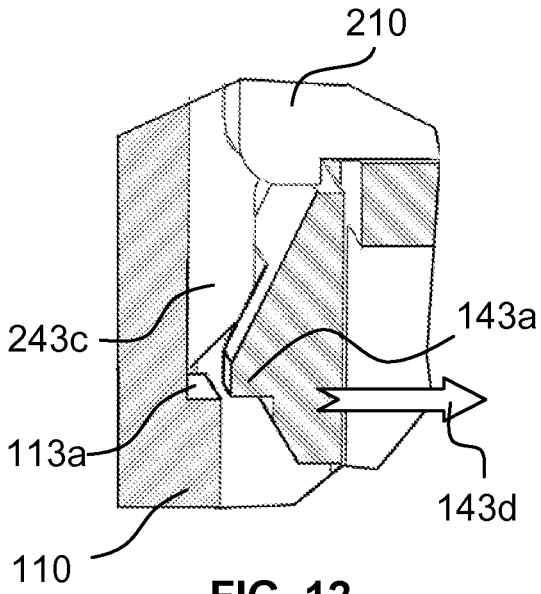
FIG. 12 is an enlarged partial cross sectional view of FIG. 9 when the locking structure is at the unlocked state.
Figure 13:
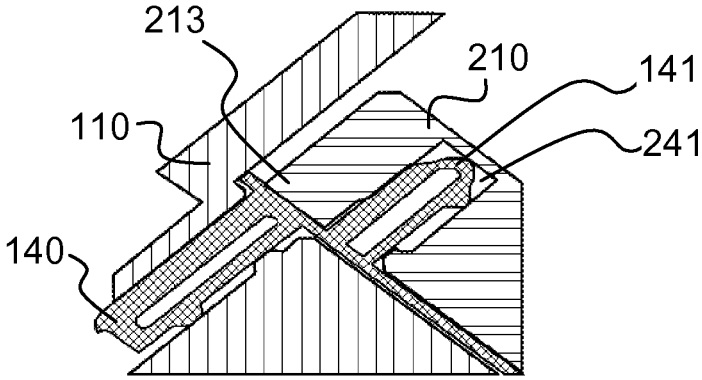
FIG. 13 is an enlarged partial cross sectional view showing a connector of FIG. 1 mated with a counterpart connector and the operation device is at the final mated position.

As shown in FIGS. 10, 11, 12 and in conjunction with FIG. 3, counterpart connector 200 further includes releasing pieces 243*c*. When connectors 100 and 200 are to mate, releasing pieces 243*c* are aligned with inclined surface 143*c* of operation device 140. By this arrangement, when protruding portion 213 of connector 200 is inserted into cavity 113 of connector 100, releasing pieces 243*c* deform end wall 143*b* of operation device, to disengage third locking projection 143*a* from shoulder 113*a*. Operation device 140 is now allowed to move towards the final mate position, by following further advancement of protruding portion 213 inside cavity 113, as shown in FIGS. 7 and 13. Meanwhile, first beam 141 of operation device 140 is inserted into groove 241 of second connector housing 210.

When connectors 100 and 200 are to be disconnected, second connector housing 200 is moved backward, i.e. along a disconnecting direction retracting from first connector housing 110. This disconnecting direction is indicated by arrow 210*d* in FIG. 14.

Figure 14:
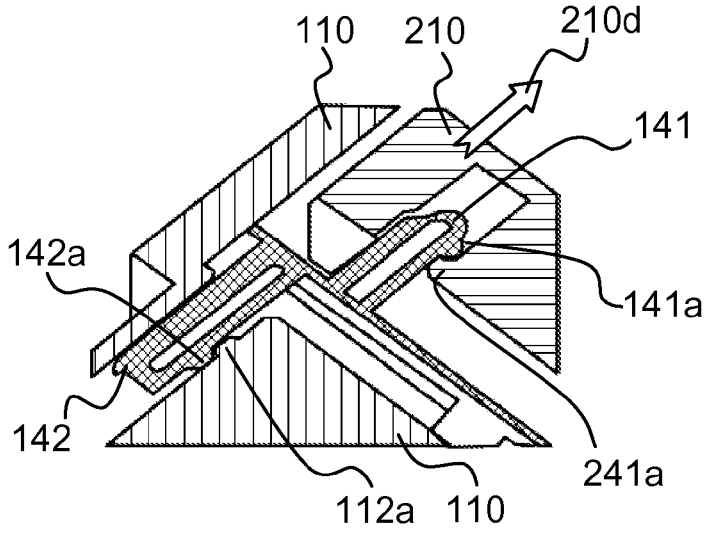
FIG. 14 is an enlarged partial cross sectional view showing a connector of FIG. 1 and a counterpart connector moving away from the final mated position shown in FIG. 13.
Figure 15:
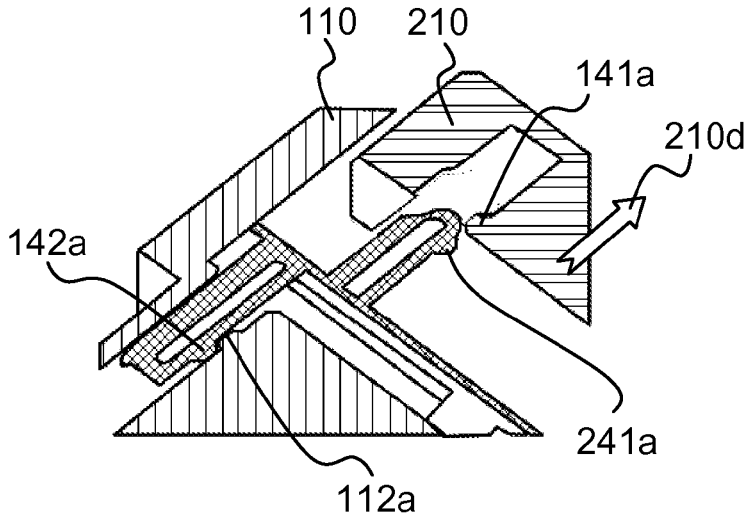
FIG. 15 is an enlarged partial cross sectional view showing a connector of FIG. 1 and a counterpart connector being completely separated.

By the engagement of first locking projection 141*a* of operation device 140 and a corresponding locking projection 241*a* formed on second housing 210, operation device 140 is also pulled by the backward movement of second connector 200 to move along disconnecting direction 210*d*. Actuator 144 is removed from the position between terminals 160 and shorting bar 120 to resume the short-circuit function of shorting bar 120 (FIG. 6). At the same time, second locking projection 142*a* and locking lug 112*a* become engaged again (FIG. 14).

The engagement force between first locking projections 141*a* and corresponding locking projection 241*a* is configured to be less than the engagement force between second locking projections 142*a* and its corresponding locking lug 112*a*. By this arrangement, when counterpart connector 200 moves further along disconnecting direction 210*d*, operation device 140 is locked at the pre-mating position by the engagement between second locking projections 142*a* and its corresponding locking lug 112*a*, and first locking projections 141*a* and 241*a* become completely disengaged. Connectors 100 and 200 are now separated from each other to complete the disconnection process.

Since actuator 144 of operation device 140 faces inside of cavity 113, there is no direct access to actuator 144 from outside of housing 110. Accordingly, actuator 144 is prevented from being damaged or deformed, e.g. during shipment and/or assembly process of connector 100. The shorting bar disconnection operation is ensured.

The invention claimed is:

1. An electrical connector system comprising a first connector having a protruding portion, a second connector having:

a housing having a cavity for receiving the protruding portion, contact terminals disposed in the housing, a shorting bar biased against two of the contact terminals to establish an electrical connection therebetween;

wherein the second connector comprises an operation device movably attached to the housing at a first position and disposed in the cavity;

wherein the housing further comprises a shoulder portion and the operation device further comprises a third locking projection, the third locking projection being engagable to the shoulder portion to retain the operation device at the first position, wherein the protruding portion comprises a releasing piece and when the protruding portion is inserted into the cavity, the releasing piece deforms an end wall of the operation device to disengage the third locking portion from the shoulder portion to allow the operation device to move towards the second position so as to disconnect the shorting bar from at least one of said two of the contact terminals.

2. The electrical connector system of claim 1, wherein the operation device further comprises a base, a first set of beams projecting from the base along a first direction, and a second set of beams projecting from the base along a second direction opposite to the first direction.

3. The electrical connector system of claim 2, wherein the housing further comprises a set of grooves each receives one of the second set of beams of the operation device.

4. The electrical connector system of claim 3, wherein each groove has a locking lug and each of the second set of beams has a second locking projection, wherein the second locking projection and the locking lug are engagable to each other with a second engagement force to retain the operation device in the housing.

5. The electrical connector system of claim 4, wherein the first set of beams is engagable to the first connector with a first engagement force which is less than the second engagement force.

6. The electrical connector system of claim 2, wherein the operation device further comprising at least one actuator projecting from the base along the second direction.

7. The electrical connector system of claim 6, wherein when the operation device is at the second position, the at least one actuator is inserted between the shorting bar and at least one of the contact terminals to disconnect the shorting bar from at least one of said two of the contact terminals.

8. The electrical connector system of claim 7, wherein the shorting bar is located in the cavity behind the operation device.

9. The electrical connector system of claim 8, wherein the shorting bar is biased against the two of the contact terminals in a region of the housing behind the cavity.

* * * * *